US006712308B1

(12) United States Patent
Fordham

(10) Patent No.: US 6,712,308 B1
(45) Date of Patent: Mar. 30, 2004

(54) CHUCK FOR A WINDING APPARATUS

(75) Inventor: Keith Fordham, Suffolk (GB)

(73) Assignee: Ashe Controls, Ltd. (GB)

( * ) Notice: Subject to any disclaimer, the term of this patent is extended or adjusted under 35 U.S.C. 154(b) by 0 days.

(21) Appl. No.: 10/031,419

(22) PCT Filed: Jul. 13, 2000

(86) PCT No.: PCT/GB00/02690

§ 371 (c)(1),
(2), (4) Date: May 23, 2002

(87) PCT Pub. No.: WO01/05694

PCT Pub. Date: Jan. 25, 2001

(30) Foreign Application Priority Data

Jul. 16, 1999 (GB) ..... 9916694

(51) Int. Cl.[7] ..... B65H 18/10; B65H 75/24

(52) U.S. Cl. ..... 242/530.3; 242/571.6; 242/571.7

(58) Field of Search ..... 242/530.3, 571.6, 242/571.7; 279/2.19, 2.2

(56) References Cited

U.S. PATENT DOCUMENTS 3,817,468 A * 6/1974 Smolderen et al. ..... 242/530.3
4,693,431 A * 9/1987 Kataoka ..... 242/530.3
4,767,077 A 8/1988 Kataoka
5,451,010 A 9/1995 Heuser

FOREIGN PATENT DOCUMENTS

| | | |
|---|---|---|
| DE | 39 18 863 A1 | 12/1990 |
| GB | 2 272 428 A | 5/1994 |
| GB | 2 300 460 A | 11/1996 |
| WO | WO 99/02442 | 11/1999 |

* cited by examiner

*Primary Examiner*—John M. Jillions
(74) *Attorney, Agent, or Firm*—Townsend and Townsend and Crew LLP

(57) ABSTRACT

A chuck is mounted on a drive shaft and torque can be transferred to an inner ring (30) of the chuck from the drive shaft. A casing (28) of the chuck surrounds the inner ring and supports four circumferentially-spaced cam elements (40) for gripping and supporting the core. Each cam element comprises a cam pivotably mounted on the housing and operated by a cam roller (58) mounted on the inner ring. Relative rotation of the inner ring and the casing causes the cam roller to move along a cam surface on the underside of its cam and to raise either end of the cam to engage the core. A switching element (80) is housed in a chamber in the casing between each pair of cam elements. Each switching element comprises a detent spring (90) having a central detent and being captive within the chamber (82), and a detent roller (88) mounted on the inner ring.

22 Claims, 13 Drawing Sheets

SECTION A-A

SECTION A-A

SECTION B-B

SECTION A-A
A
A
42
44
46
47
48
56

CHUCK FOR A WINDING APPARATUS

The invention relates to a chuck for a winding apparatus for carrying and driving a core onto which a web is to be wound or rewound. The invention finds particular application in the rewinding industry, but is also applicable in other areas.

BACKGROUND ART

In the rewinding industry, differential winding is an industry wide term used for a system of rewinding flat sheet products (webs) onto tubes that support the finished product. The tubes are called cores and are usually made from cardboard or, more rarely, plastics, steel, aluminium, or composites. The flat sheet product, or web, can be anything supplied or used in reel, or roll, form. Paper, films, printed packaging and laminated products are most commonly processed. Usually the product is supplied for final rewinding onto cores from larger bulk reels or from a process machine.

The final rewinding process usually also involves another process called slitting, carried out using a combined slitter rewinder machine. This cuts the product formed in earlier processing into narrower widths. Typically, for example, a printing machine would produce printed packaging 1600 mm wide with a number of repeated patterns across its width. The slitting process cuts the full width into individual widths, typically for further use on subsequent machinery for packaging. Confectionery packaging for example uses this process.

After slitting, the individual widths are rewound either alternately onto two spaced, parallel rewinding shafts or side by side onto one shaft in known manner. A means of locating the cores into position and locking them onto the shaft or shafts is employed. The shaft or shafts is/are driven to provide tension, with the aim of enabling the product to be wound to with high quality and repeatability. The speed of processing is typically 7.5 m/s but in some machines is engineered to be 16.6 m/s. The main criterion for producing acceptable quality for the finished rolls is tension control.

Two systems exist for this. The first and generally the least sophisticated is termed as lock bar winding. This describes the cores being locked onto the rewind shaft and rotating in unison with it, the rewind shaft being driven by a drive motor. The sheet, or web, tension is thus distributed across the whole web width and is controlled by the drive motor torque. The torque is varied to give the desired winding tension and is usually varied to maintain a constant sheet tension throughout the reel as the diameter increases. Various means are available for establishing the roll diameter at any time during winding and this can be used to give increasing torque to the shaft to maintain a constant tension rewind as reel diameter increases during winding. Taper tension (decreasing web tension progressively) can also be used and gives reduced web tension proportionally as the reel diameter increases. Taken to the extreme this is sometimes termed constant torque winding.

The second means of rewinding is differential winding. This aims to compensate for variations in material parameters, such as thickness, across the web. Considering that several thousand layers of material can rewound onto a single reel, if there is a web thickness variation of just one micron, the resulting finished reel diameter can be significant. Lock bar winding has limitations due to this effect; when two or more reels are carried on one shaft, as the reel with the largest diameter due to thickness variation across the width of the supply web builds in diameter its web speed increases and this reel takes more tension, reducing the tension in the other reel on the same shaft. Differential winding allows each core to rotate at a different speed, however slight, and through the differential system aims to maintain a constant tension on each reel regardless of reel diameter.

There are many systems for differential winding available, but they all suffer in one or more areas with limitations as to their use. Typically a system consists of a driven shaft approximately 50 mm diameter (the most common core internal diameter=3") with core holders positioned on the shaft line with the cores. Core position along the shaft is adjusted using plain spacers; either side of each core holder is a spacer.

The spacers are keyed to and driven by the shaft and the core holders are freely rotatable relative to the shaft, being supported on plain bearings, such as bronze, plastic or similar bushings. The core holders are separated from the spacers by friction elements and driven by torque transfer from the spacers via the friction elements.

The shaft is driven about 5% faster than the web speed. This is termed overspeed. It is advantageous to keep the overspeed as low as possible to reduce heating at the friction elements. In use, the shaft carries a stack of core holders and spacers along its length and a variable axial load can be applied to the stack. The driven spacers either side of each core holder are thus loaded axially on to the friction elements which in turn load the sides of the core holder to provide torque to the core. By varying the axial load the torque is varied to the core holders.

This conventional system has fundamental faults in trying to maintain a constant controllable rewind tension. One problem relates to the bushings within the core holders. Web tension is generated through friction from the bushings, which increases as the reel weight increases during winding and becomes an uncontrolled component of the tension.

Additionally, because the core holders are located axially, a tension gradient is produced along the shaft. The first core holder is loaded with all the axial force and when the tension required is very light the core holder at the other end of the shaft sees very little of the remaining force due to friction on the bushings and weight of the reels along the shaft. With more reels and weight the problem increases.

Other problems can be generated by the use of lay on rollers. These are used when high speed winding generates a layer of entrained air between layers of the reels. This layer of air acts as a lubricant affecting the stability of the reels, The lay on rollers are usually run on the upper surface of the reels under pressure to expel air, and this downward pressure also generates more unwanted tension in the rewind reels.

Set up time in adjusting the position of the core holders is also a restriction in the use of this conventional system. One known solution to this problem is to fill the shaft with core holders allowing the cores to be positioned anywhere along the shaft. The disadvantages of this arrangement include the across shaft tension difference, weight and cost.

Regarding the across shaft winding tension difference, this arises because of the larger number of core holders to be driven. If the core holders are driven as described above using a shaft end load to control drive torque, the core holders near to the shaft end where the end load is applied receive a larger end load and are therefore driven at higher torque than the core holders at the other end of the shaft.

Lubricants are sometimes employed to alleviate this effect but with detriment to hygiene. Problems can also arise as the (cardboard) cores commonly generate dust, which can contaminate any lubricant used.

A known design to overcome the problems of using shaft end load to control core torque is to use a separate form of core holder known as a differential chuck, and a corresponding shaft as described below. The driven shaft incorporates four air-inflatable flexible tubes along its length and corresponding friction segments which are pushed radially outwards by the tubes as they are inflated. Each differential chuck comprises a steel-lined inner surface on which the friction segments act to transfer torque from the shaft to the differential chuck. The force acting on the inner ring is proportional to the air pressure, which is controlled to control the torque transmitted evenly to all differential chucks on the shaft.

In such a design, each chuck is assembled on the shaft to form a complete unit and is fixed in position on the shaft to cooperate with a corresponding set of friction segments. In a rewinding machine a shaft may carry typically 80 chucks. This complete unit is termed a differential shaft. Two spaced, parallel differential shafts are typically fitted to a rewinder, conventionally termed a duplex rewinder.

A differential chuck must have an outside diameter smaller than the internal diameter of a core so that cores can be slid onto and off the differential shaft from its end, but must also grip the interior of the core during winding. To achieve this, each chuck is usually provided with a locking mechanism comprising cams which rise from the chuck outer surface to grip the surrounding core. The cams are driven by the shaft applying a torque to the chuck inner surface. A single direction locking mechanism is always used to ensure that when the cores are unlocked (by which time they may be carrying heavy reels of wound material) shaft or reel rotation in the opposite direction does not relock them. If a two-direction locking mechanism is used, a particular problem can arise because all of the chucks can only be driven either simultaneously or not at all. The problem arises when two cores are under the same reel and one unlocks while the other stays locked. Counter rotation will unlock the locked one but will inevitably lock the unlocked one, preventing reel removal.

The use of single direction locking chucks means that when it is necessary to reverse the winding direction of a differential shaft, it is necessary to dismantle the shaft and reverse the orientation of all of the chucks.

Other systems available can be called differential shafts. These have various designs but all rely on the shaft having built-in units providing radial force directly to the inside of the core with resultant core dust and friction problems with the cores running directly onto the shafts.

Low tension winding is often desirable for today's materials but none of the conventional systems addresses this satisfactorily. For example, it is necessary to slit and rewind dye sheet for thermal colour printing before it can be used. Dye sheet may only be 3 micrometers thick and is slit into widths of only 15 to 30 cm. Very low winding tensions are required to handle narrow, delicate webs of this type, which are becoming more common as modern packaging and other industries develop, and existing winding shafts are unable to do this with sufficient consistency and accuracy. Also, all conventional systems suffer at least one of the problems of the need for clean, dust free operation, or the need to dismantle the winding shaft for reel width and direction changes.

SUMMARY OF THE INVENTION

The invention provides a chuck for a winding or rewinding apparatus and a method for mounting a core on a winding machine.

The invention may thus advantageously provide a chuck which can be switched between a first state, in which torque supplied by the drive shaft of a winding machine is transferred through the chuck to a core surrounding the chuck, and a second position in which the chuck does not engage the core and in which no torque can therefore be applied.

Further advantageously, the invention may provide a chuck in which this switching operation can be performed by an operator before cores are loaded onto a winding shaft (differential shaft) of a winding machine without any disassembly of the chucks or the shaft. In a preferred embodiment, the switching operation is achieved by locking an inner ring of each chuck by operating a torque-transfer element of the drive shaft, such as a friction segment, and rotating an outer casing of the chuck to a predetermined position or series of positions.

In a preferred embodiment, therefore, a row of chucks embodying the invention may be mounted on a differential shaft and a winding operation performed by pre-setting each chuck to an anticlockwise driving position, a clockwise driving position or an off position before cores are mounted on the shaft. The chucks can thus be switched so that a pre-selected number of the chucks within each core drives each core in order to enable a predetermined range of torque to be applied to each core during winding.

Further advantageously, the casing of the chuck embodying the invention may be mounted on the drive shaft by means of ball bearings, to reduce torque transfer due to friction.

DESCRIPTION OF SPECIFIC EMBODIMENTS

Specific embodiments of the invention will now be described by way of example with reference to the drawings, in which.

Figure 1:
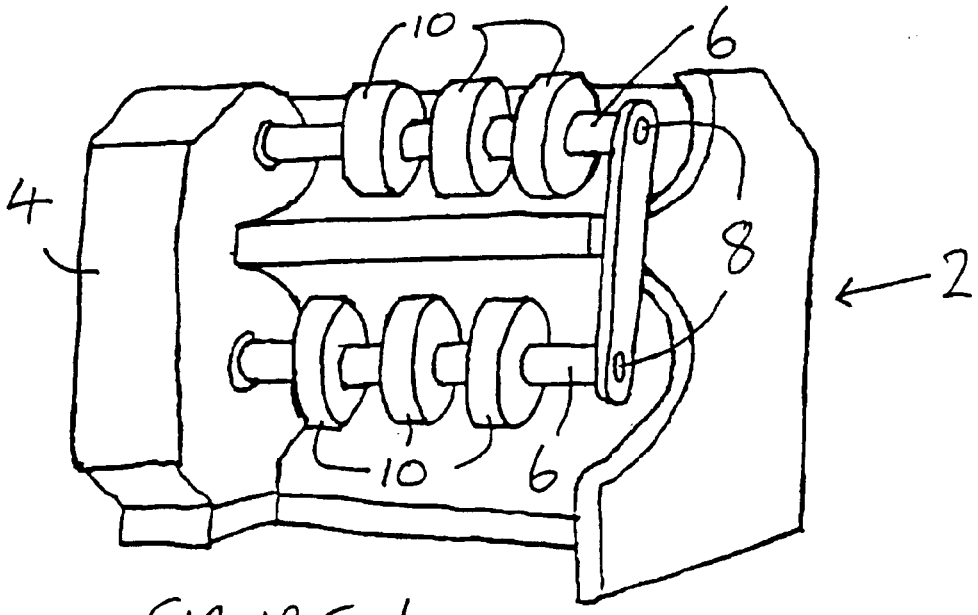
FIG. 1 is a perspective view of a duplex rewinder machine winding six reels on alternate shafts.
Figure 2:
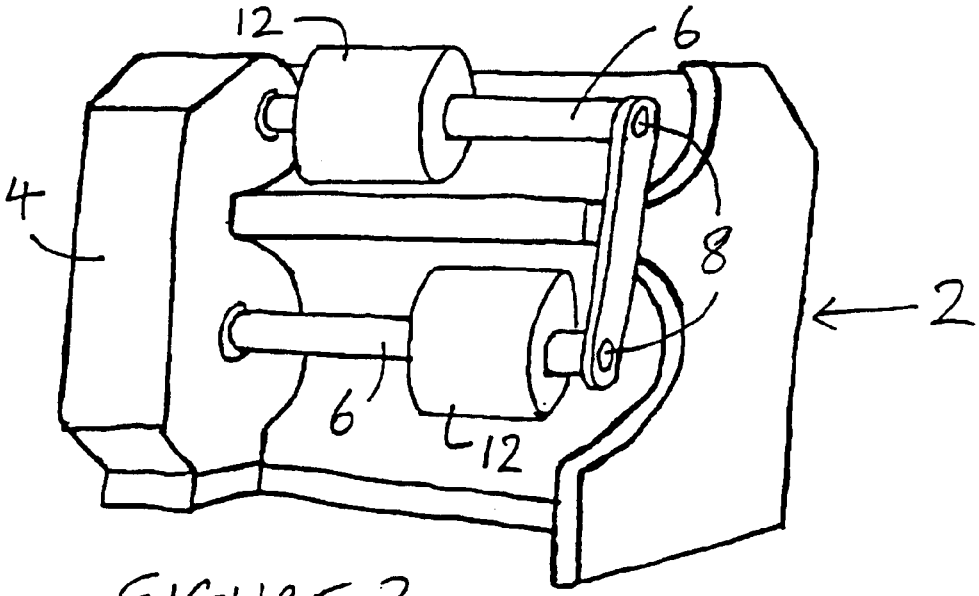
FIG. 2 is a perspective view of the duplex rewinder machine of FIG. 1 winding two wide reels on alternate shafts.
Figure 3:
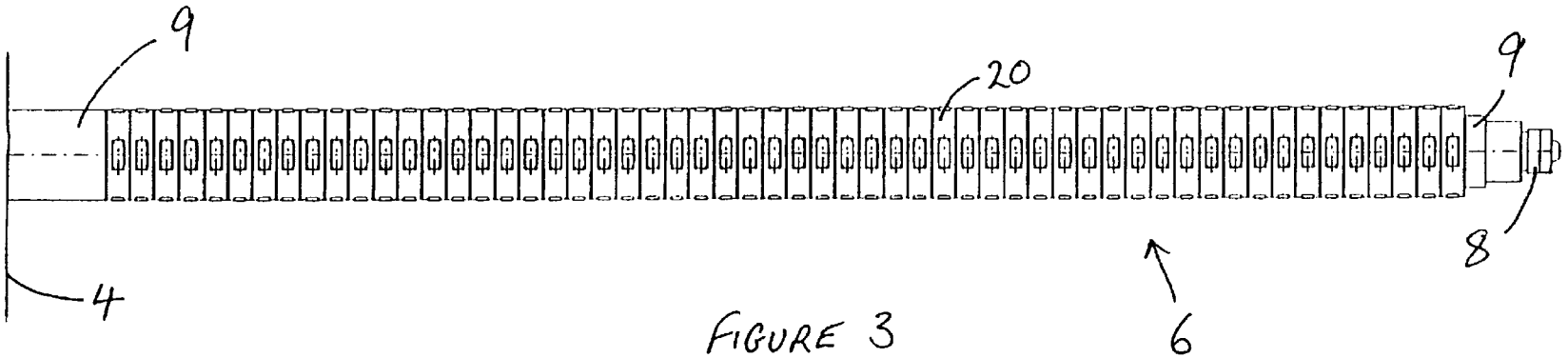
FIG. 3 is a radial view of a differential shaft embodying the invention.

FIGS. 1 and 2 are illustrations of a duplex winding machine. In each case the machine comprises a body 2 including a motor unit 4. Two spaced, parallel rewinding shafts 6 extend at one end from the motor unit and are supported in removable bearings 8 at their opposite ends. Each shaft 6 is a differential shaft as illustrated in FIG. 3, having a row of differential chucks mounted along the length of a drive shaft 9. During rewinding, cores for rewinding slit webs are carried by some of the chucks on each shaft. A wide supply web is mounted at the rear of the duplex rewinder machine (not shown) and slit within the machine by slitting knives (not shown). The slit webs are rewound onto the cores on the shafts 6. FIG. 1 illustrates six rewound reels 10. The supply web has been slit into six narrow webs and adjacent webs have been rewound on alternate shafts 6. In FIG. 2, a supply web has been slit into two wider webs which have been rewound onto reels 12 on alternate shafts 6. It should be noted that the wider cores of the rewound reels 12 in FIG. 2 each span many more chucks on the winding shafts than the narrower cores of the rewound reels 10 in FIG. 1.

Figure 4:
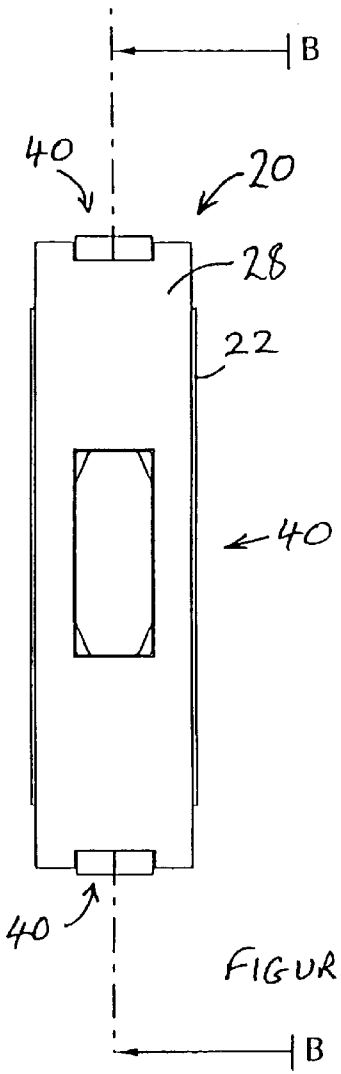
FIG. 4 is a radial view of a chuck according to a first embodiment of the invention.
Figure 5:
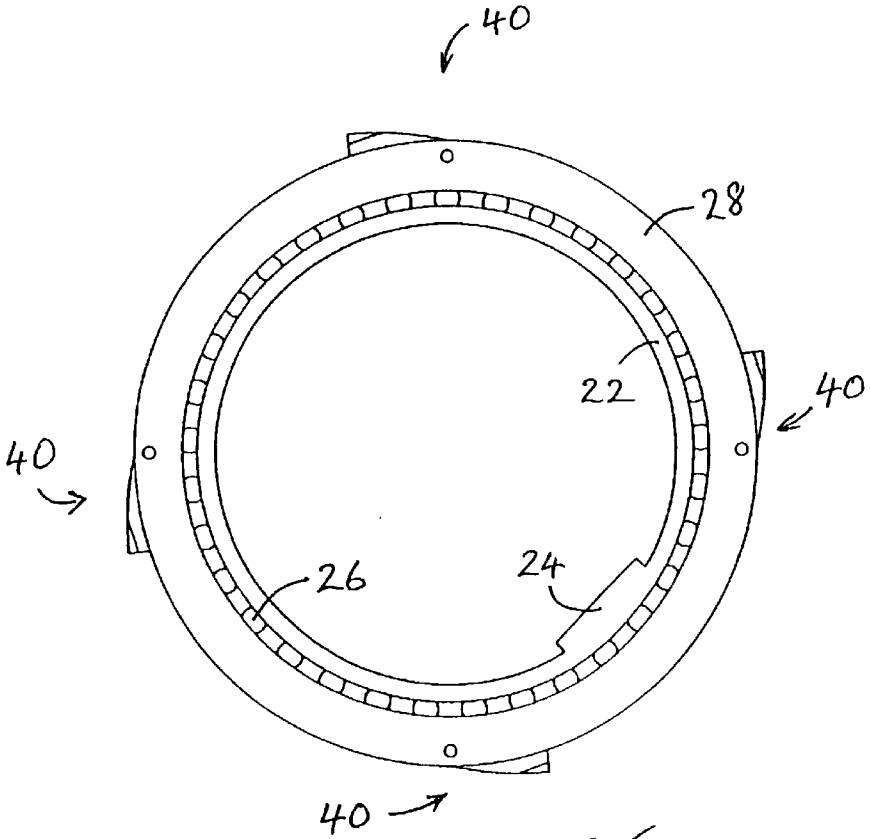
FIG. 5 is an axial view of the chuck of FIG. 4.
Figure 6:
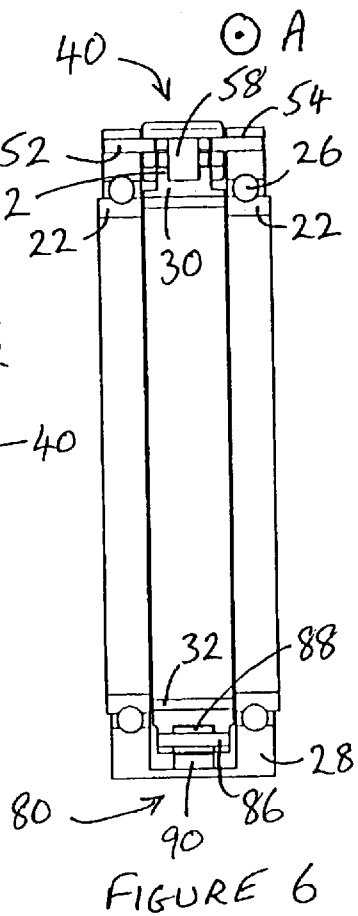
FIG. 6 is radial section on A—A (see FIG. 7) of the chuck of FIG. 4.
Figure 7:
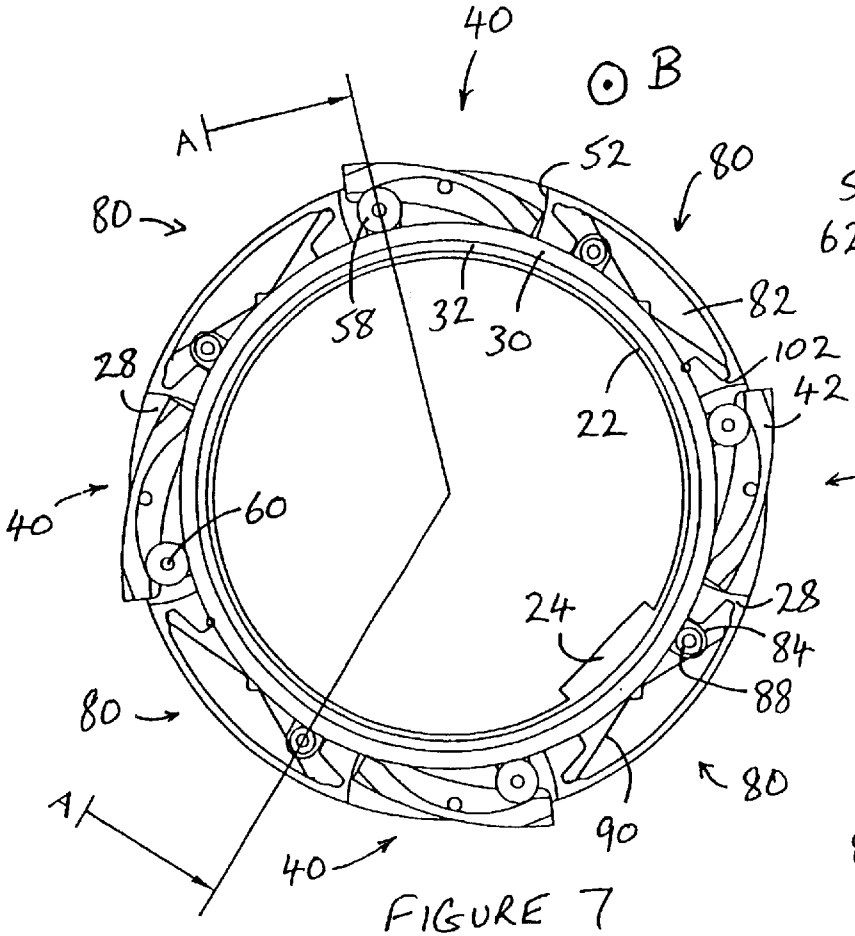
FIG. 7 is an axial section on B—B (see FIG. 4) of the chuck of FIG. 4.

FIG. 3 is a side (radial) view of one of the shafts 6 extending from the motor unit 4. It comprises a row of differential chucks 20. FIG. 4 shows an enlarged side (radial) view of one of the chucks 20 according to a first embodiment of the invention. FIG. 5 is an end (axial) view of the chuck and FIGS. 6 and 7 are axial and radial sections of the chuck respectively.

Figure 8:
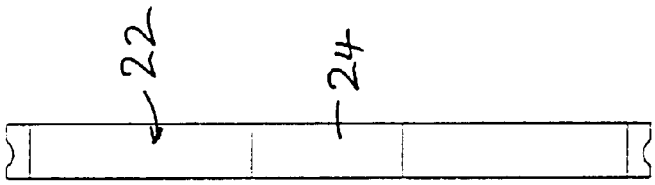
FIG. 8 is a radial section of an inner bearing race of the chuck of FIG. 4.
Figure 9:
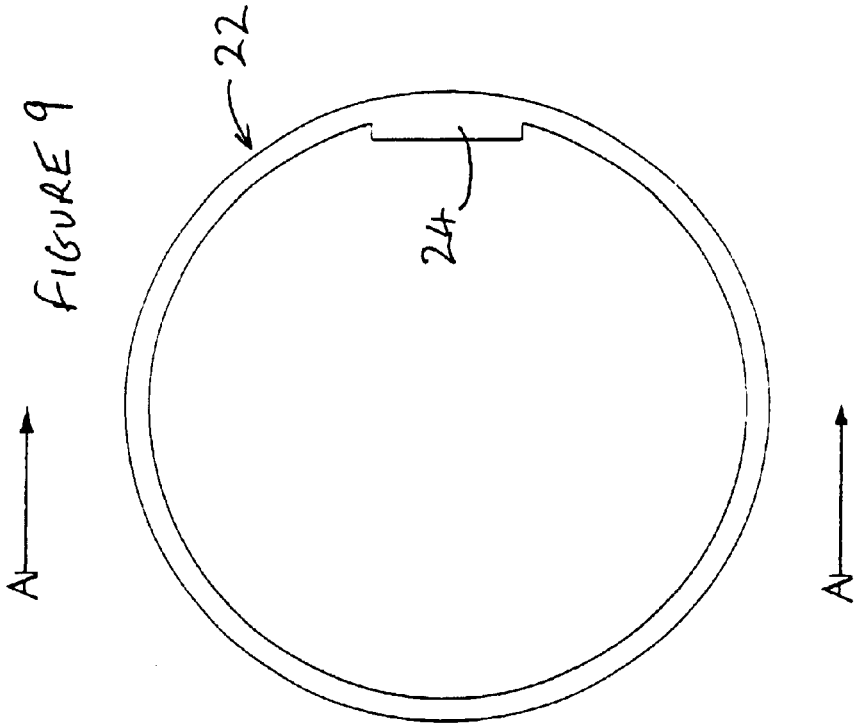
FIG. 9 is an axial view of the inner bearing race of FIG. 8.

The chuck is mounted on the drive shaft 9 on the two inner races 22 of two axially spaced ball races. Each inner race is keyed to the shaft by a key 24. FIGS. 8 and 9 illustrate a single inner race 22. Caged ball bearings 26 run between the inner races and two outer races formed in an outer casing 28 of the chuck. The outer casing is moulded from a hard plastic such as acetal in two halves, one of which is illustrated in FIGS. 10, 11, 12 & 13. The two halves are fastened together on assembly of the chuck, for example by glueing, to form the casing 28.

An inner ring 30 is captive within the casing 28 but free to rotate relative to it to a limited extent as will be described below. The inner portion of the inner ring comprises a friction surface 32, which is positioned between the inner races 22 but is of slightly larger internal diameter. Thus, when the chuck is mounted on the shaft, the inner races contact the shaft surface but the braking surface does not. As in a conventional differential shaft, the drive shaft 9 incorporates friction segments 34 (see FIGS. 29 to 32). The friction segments can be raised into contact with the friction surface 32 by inflatable tubes 36 running axially along the length of the drive shaft 9 to transfer a torque to the friction surface controlled by the air pressure.

The chuck comprises four cam elements 40, spaced at 90 degree intervals around the chuck. The function of the cam elements is to support a winding core to keep it accurately centred with the shaft and to grip the core such that torque transferred from the shaft to the braking surface 32 is transferred to the core without any slippage. Each cam element 40 comprises a cam 42, which is illustrated in more detail in FIGS. 17 to 20. The cam has an outer surface 44 which is curved to match the outer surface of the casing 28. Flanges 46 extend inwardly from the axial edges of the cam and pivot holes 48 are formed centrally in each flange for receiving pivot pins 50. A generally rectangular opening 52 is formed in the casing 28 to house each cam element and the pivot pins 50 extend from holes 54 defined in the axially-spaced side walls of each generally rectangular opening 52 into the corresponding pivot holes 48 in the cam. The cam is thus held captive within the casing but can pivot about the pivot pins.

On the inner surface of the cam, between the flanges 46, a cam surface 56 is defined. The cam surface cooperates with a cam roller 58 which is rotatably mounted on stub axles 60 between flanges 62 extending outwardly from the inner ring 30 of the chuck. The axis of the stub axles 60, like that of the pivots 52, is parallel to the axis of the drive shaft 9.

Figure 29:
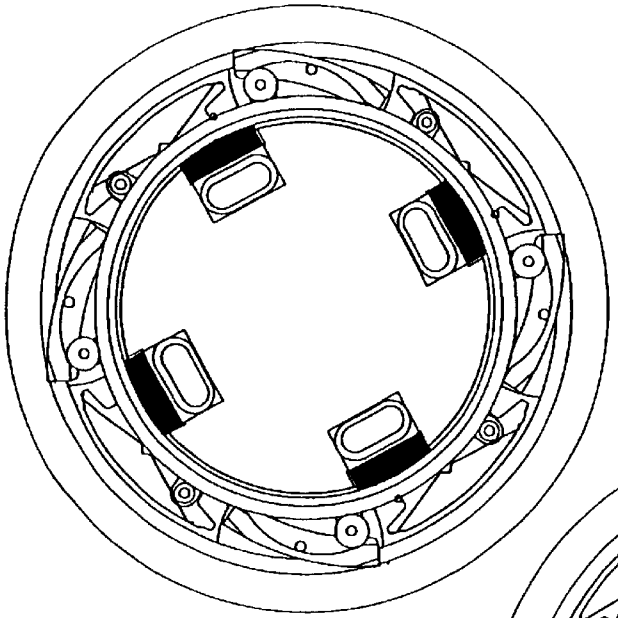
FIG. 29 is an axial section of a core supported on the chuck of FIG. 4 in position for anticlockwise rotation.

In operation, if an anticlockwise torque is applied by the shaft to the inner ring 30 (as illustrated in FIGS. 4 to 7) such that the inner ring is urged to rotate anticlockwise relative to the casing 28, in each cam element 40 the cam roller 58 rolls along the cam surface 56 to raise the anticlockwise-facing end of the cam 42 proud of the radially-outer surface of the casing 28. The cam is formed with a sharp corner 64 at each end of its outer surface 44 and the relative movement of the cam roller and the cam surface thus raises the sharp corner 46 into the inner surface of a core surrounding the chuck. A core held in this manner for anticlockwise rotation is illustrated in FIG. 29.

Figure 31:
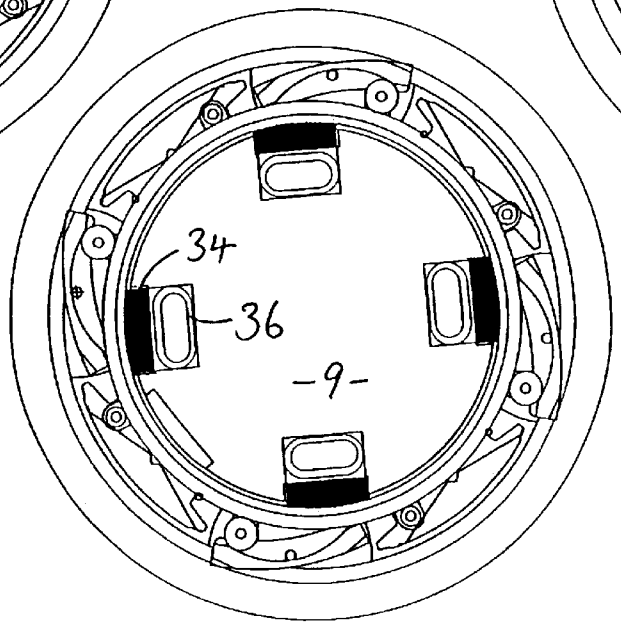
FIG. 31 is an axial section of a core supported on the chuck of FIG. 4 for clockwise rotation.

By contrast, if the shaft applies a torque to the inner ring such that the inner ring is urged to rotate clockwise relative to the casing, the clockwise-facing corner of each cam will be lifted and will grip the inner surface of a surrounding core. This position is shown in FIG. 31.

Figures 10, 11, 12, 13:
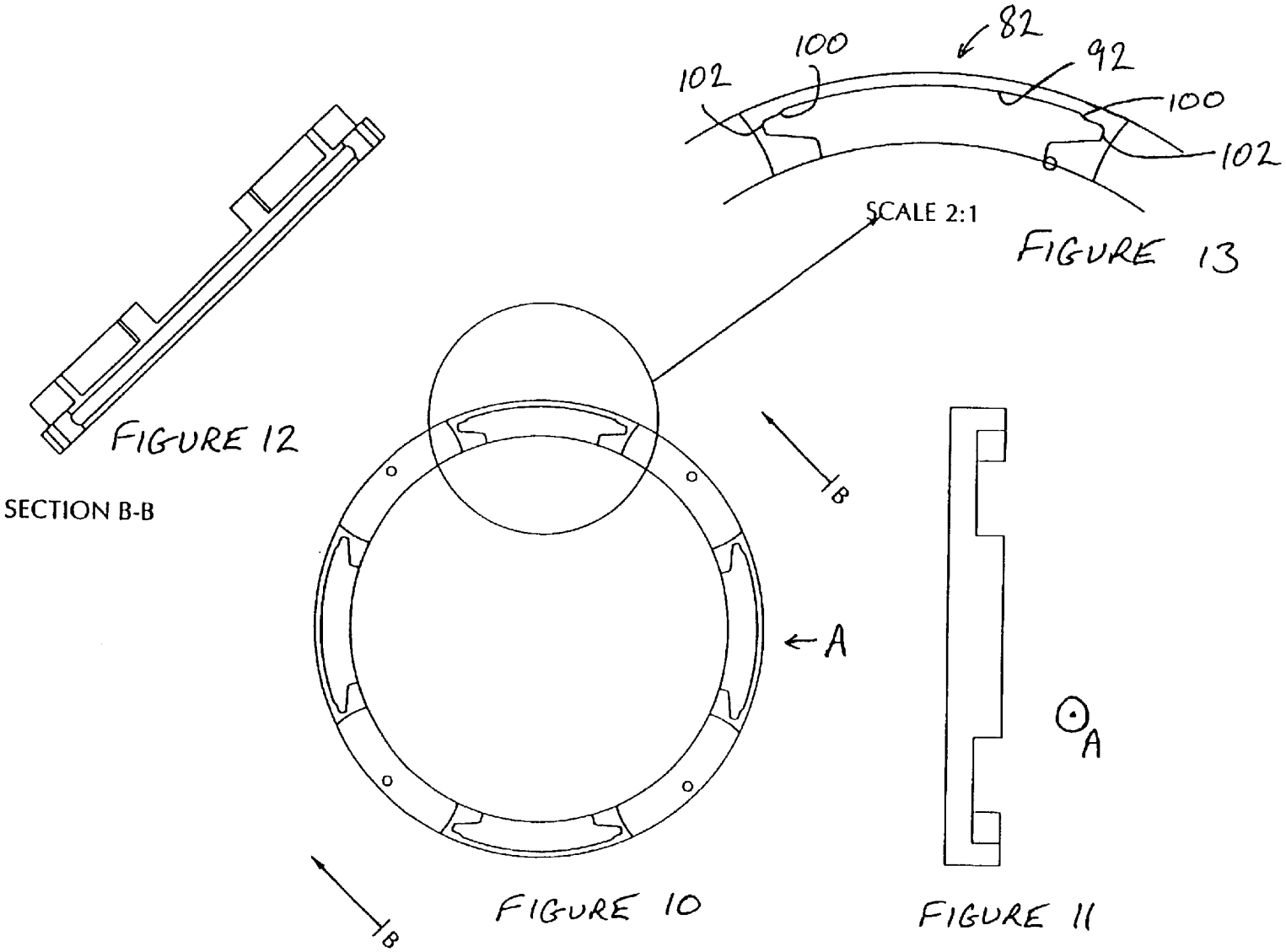
FIG. 10 is an axial view of a moulding forming half of the casing of the chuck of FIG. 4.
FIG. 11 is a radial view in direction A of the moulding of FIG. 10.
FIG. 12 is a radial section on B—B of the moulding of FIG. 10.
FIG. 13 is an enlarged view of the circled portion of the moulding of FIG. 10.
Figure 15:
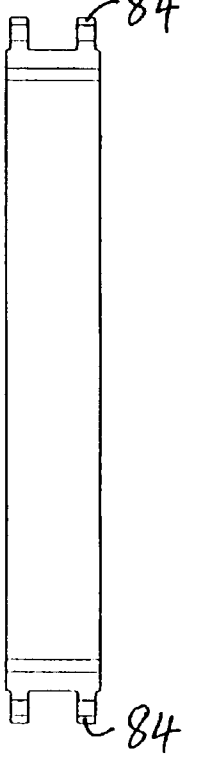
FIG. 15 is a radial section on A—A of the inner ring of FIG. 14.
Figure 14:
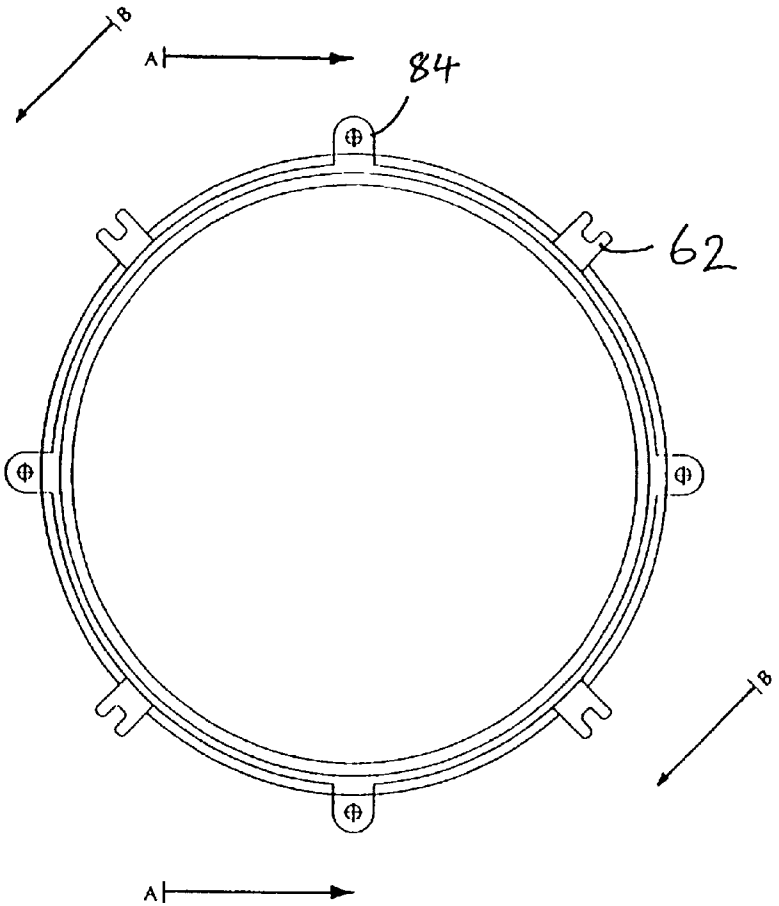
FIG. 14 is an axial section of the inner ring of the chuck of FIG. 4.
Figure 16:
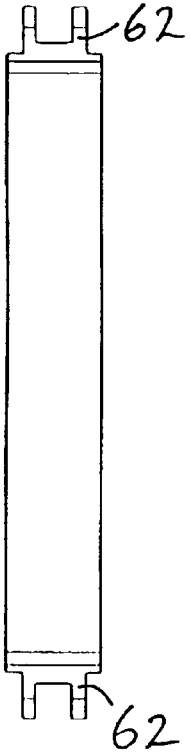
FIG. 16 is a radial section on B—B of the inner ring of FIG. 14.
Figures 17, 18, 19, 20:
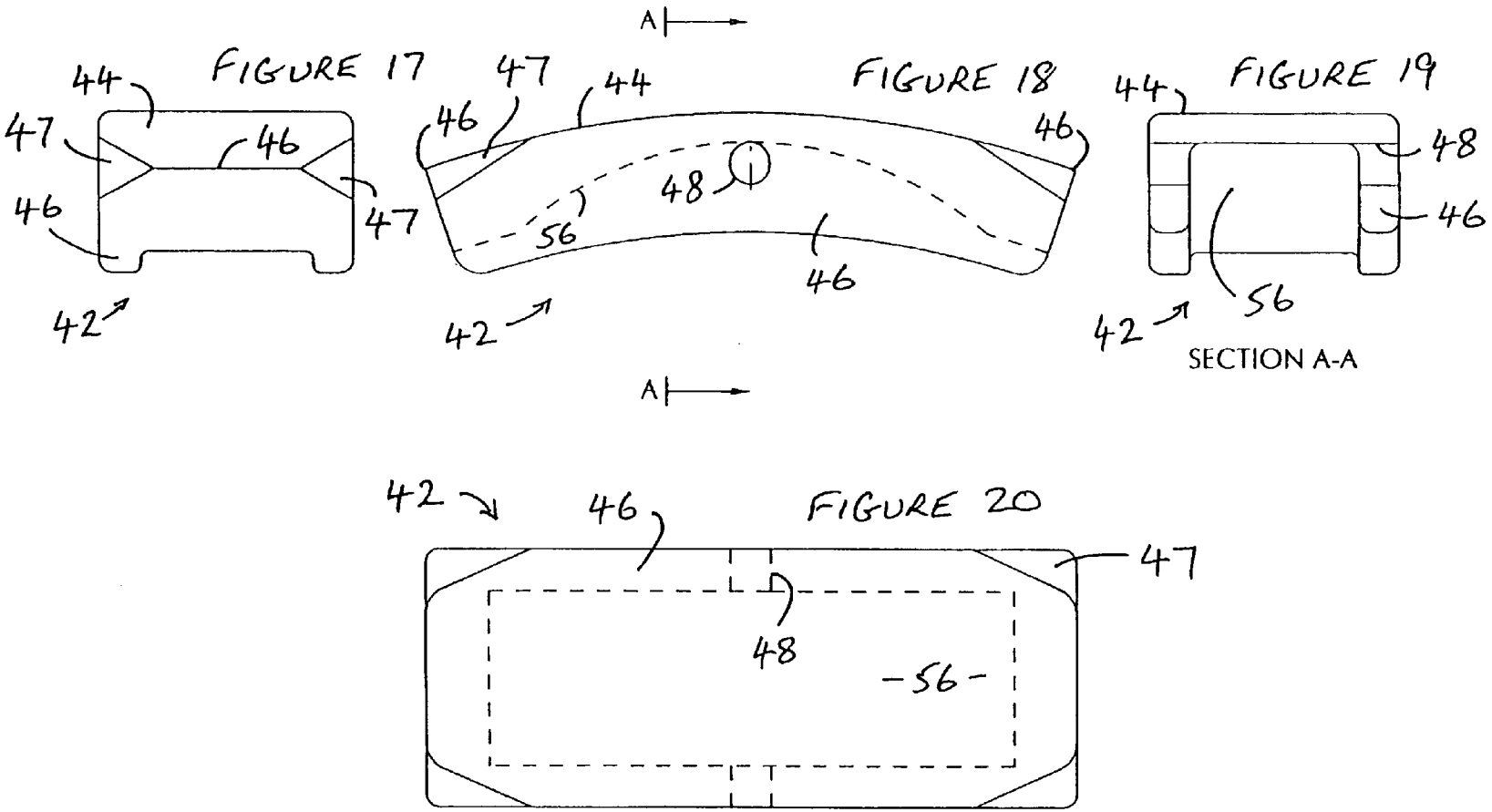
FIG. 17 is an end view of a cam of the chuck of FIG. 4.
FIG. 18 is a side view of the cam of FIG. 17.
FIG. 19 is a transverse section on A—A of the cam of FIG. 17.
FIG. 20 is a plan view of the cam of FIG. 17.
Figure 21:
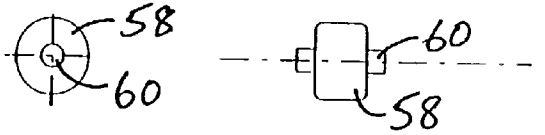
FIG. 21 shows axial and radial views of a cam roller of the chuck of FIG. 4.
Figure 22:
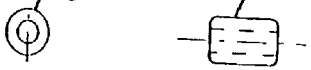
FIG. 22 shows axial and radial views of a detent roller of the chuck of FIG. 4.

The chuck further comprises four switching elements 80, which are spaced at 90 degree intervals around the circumference of the chuck, each switching element separating two cam elements. Each switching element is housed within a switching chamber formed in the casing 28. FIG. 13 shows an enlarged section of a switching chamber 82. The inner wall of the chamber is formed by an outer circumferential surface of the inner ring 30, from which two flanges 84 extend. An axle 86 extends through holes in the flanges to rotatably support a detent roller 88 (as illustrated in FIG. 22) between the flanges. The axis of rotation of the roller is parallel to the axis of the drive shaft 9. As the inner ring 30 rotates relative to the casing 28, as described above for pivoting the cams 42, each detent roller moves within its switching chamber 82.

Figure 23:
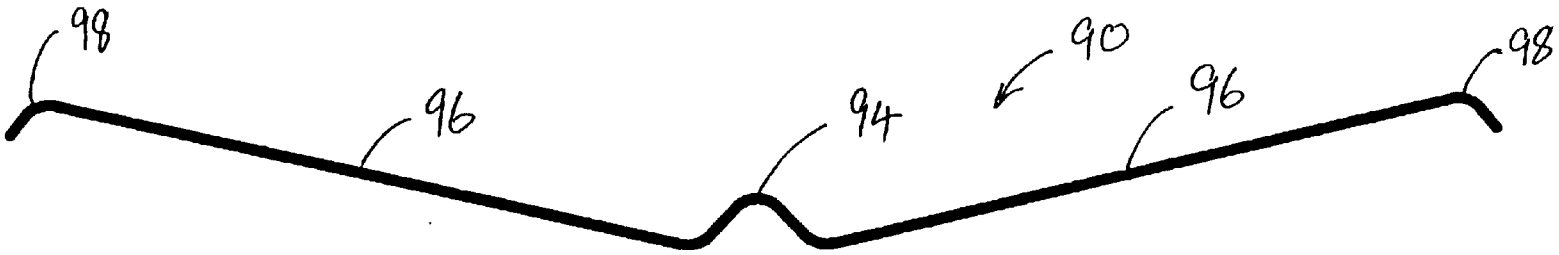
FIG. 23 is a side view of a detent spring of the chuck of FIG. 4.
Figure 24:
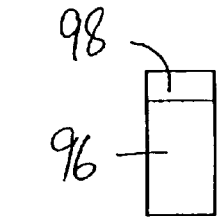
FIG. 24 is an end of the detent spring of FIG. 23.

A detent spring 90 (illustrated in FIGS. 23 and 24) is captive within the chamber of each switching element. The spring is retained between the inner ring and the detent roller, on its radially-inward side, and a radially-outer wall 92 of the chamber 82 on its radially-outward side.

The detent spring 90 is formed from a strip of spring steel of rectangular cross section. It is symmetrical about its centre, where it is bent to form a detent 94. Straight portions 96 of the detent spring extend away from the detent 94 on either side, at an oblique angle. Each end of the detent spring is bent to form a pawl element 98. When the detent spring is housed in the chamber of a switching element, the detent faces radially inwards, for engagement with the detent roller, and the pawl elements face radially outwards. The outer wall. 92 of the chamber has a smooth circumferential surface except where an angled step 100 is formed near each end. The precise position and separation of the angled steps will become clear from the functional description below.

Figure 25:
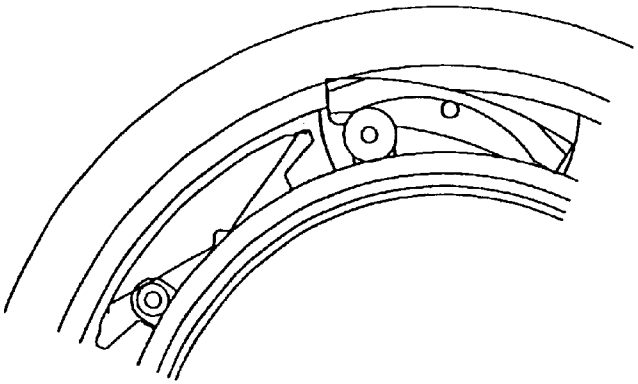
FIG. 25 is an axial section of a switching element and a cam element of the chuck of FIG. 4 in a first position.

The operation of a switching element is as follows. Each switching element can be switched between three stable positions. In a first position, as shown in FIGS. 7, 25 and 29, the inner ring 30 is rotated anticlockwise relative to the casing 28 so that the detent roller is near the anticlockwise end of its chamber 82. The detent spring is displaced clockwise within the chamber by the detent roller so that the pawl element 98 at the clockwise end of the detent spring abuts the clockwise end face 102 of the chamber. When the switching element is in this position, the cam roller 58 of each cam element 40 has pivoted its cam 42 so that the anticlockwise-facing end of the cam protrudes from the surface of the casing. With the switching element in this position, therefore, the chuck can support and drive a core anticlockwise.

Reference is now made to FIGS. 25 to 28 which illustrate a switching element and an adjacent cam element in various positions. FIG. 25 shows the same position as FIG. 7.

Figure 26:
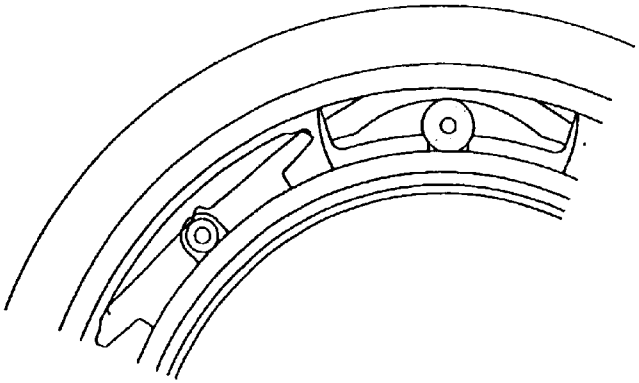
FIG. 26 is axial section of the switching element and the cam element of FIG. 25 in a second position.

When the switching element is in this position, if an opposite torque is applied, tending to rotate the inner ring clockwise relative to the casing, the detent spring presses against the detent roller and resists the clockwise rotation of the inner ring, urging the roller back towards the anticlockwise end of the switching chamber. However, with the switching element in this anticlockwise driving position it is necessary to be able to move the inner ring relative to the casing to a position where the cam roller is centred beneath the cam in each cam element. At this point, the cam element lies flush with the outer surface of the casing and a core can be slid over the chuck. FIG. 26 shows the chuck in this position. At this point, the detent spring in the switching element is offset towards the clockwise end of the switching chamber such that, although the detent roller is centrally positioned within the chamber, it is in contact with the straight portion 96 of the detent spring on the anticlockwise side of the detent 94. Therefore, if the chuck casing (or inner ring) is released at this point, the detent spring urges the detent roller anticlockwise relative to the casing and thus tends to raise the anticlockwise end of the cam in each cam element as shown in FIG. 25. This tendency is reinforced, of course, when an anticlockwise torque is applied to the inner ring 30 from the drive shaft 9 during winding.

In practice, when the switching element is in this first position for driving a core anticlockwise, when a core is slid over the chuck, the core tends to depress the protruding end of each cam, aided by a chamfer 47 on each outer corner of each cam, and thus tends to rotate the casing anticlockwise relative to the inner ring towards the position shown in FIG. 26. This allows easy loading and positioning of cores on the differential shaft.

Figure 28:
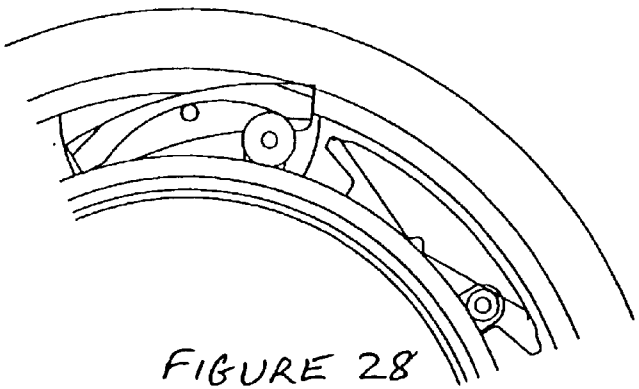
FIG. 28 is an axial section of a switching element and a cam element of the chuck of FIG. 4 in a fourth position.

If it is desired to drive a core clockwise, a second switching position of the switching element is required, illustrated in FIG. 28. To reach this position from the anticlockwise driving position, the friction segments 34 in the drive shaft 9 are pressed against the inner ring 30, to lock the inner ring in position, while an operator rotates the casing 30 of the chuck anticlockwise. This operation forces the detent roller past the detent and towards the clockwise end of the chamber 92. The presence of the detent roller in this position urges the detent spring anticlockwise within the chamber until it abuts the anticlockwise end face 102 of the chamber. Subsequent operation of the chuck is a mirror image of its operation in the anticlockwise driving position described above.

Figure 27:
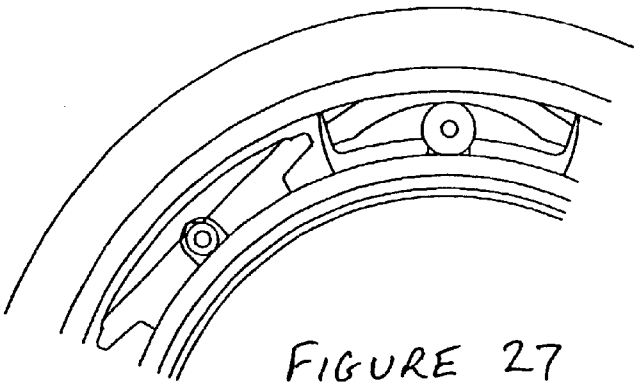
FIG. 27 is an axial section of the switching element and cam element of FIG. 25 in a third position.

The switching element can occupy a third operating position, in which the cam in each cam element is held flush with the outer surface of the casing. This position is illustrated in FIG. 27, in which the detent roller is centrally positioned in the switching chamber and is retained in the detent 94. Also, the pawl elements at each end of the detent spring are located against the angled steps 100 near each end of the chamber. In this position, the detent retains the detent roller in its central position and correspondingly retains the cam roller in each cam element in a central position. This in turn retains each cam flush with the outer surface of the casing so that it cannot engage with a core. To set the switching element in this third position, the inner ring is locked by means of the friction segments 34 in the drive shaft 9. Then, assuming that the switching element is in the anticlockwise driving position illustrated in FIG. 25 with the detent roller near the anticlockwise end of its chamber, an operator rotates the casing of the chuck anticlockwise until the detent roller engages the detent. It will be noted that to achieve this the casing must be rotated anticlockwise beyond the central position illustrated in FIG. 26 achieved when loading cores with the switching element in the anticlockwise driving position. When the detent roller has engaged the detent, the operator then rotates the casing clockwise until the pawl elements at each end of the detent spring engage the steps 100 near each end each chamber; the detent spring remains stationary relative to the detent roller during this step. The position illustrated in FIG. 27 is then achieved, in which all components of the switching elements and cam elements are centred. It should be noted that the separation of the angled steps 100 in the radially-outer surface of the chamber is selected to retain the detent spring between the steps when the detent roller is engaged in the detent.

In this position, in which the chuck is effectively switched off, during winding the chuck cannot engage a core even if a core is in position over it, because the cam is retained flush with the outer surface of the casing. Therefore, no drive can be transferred from the shaft to the core via that chuck.

Figure 30:
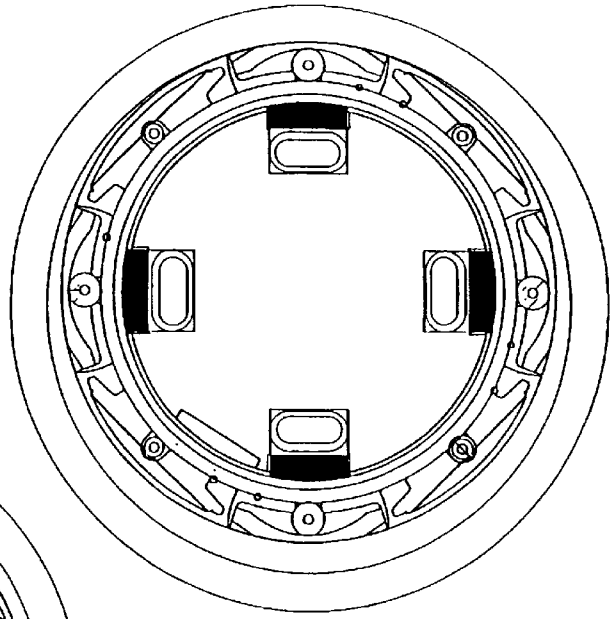
FIG. 30 is an axial section of a core encircling the chuck of FIG. 4 in an off position.

FIGS. 29,30 and 31 are cross sections of a core encircling a chuck showing the chuck in, respectively, the anticlockwise driving position, the off position and clockwise driving position.

In use, before any cores are positioned on a differential shaft embodying the invention, an operator can lock the inner rings of all of the chucks by raising the air pressure in the inflatable tubes within the shaft and raising the friction segments 34 into contact with each inner ring. The operator can then rotate the outer casing of each chuck as described above so as to switch each chuck either into the anticlockwise driving position, or the off position, or the clockwise driving position. As the operator handles each chuck, he can clearly feel and see the positions of the switching elements. To set a chuck to the anticlockwise or clockwise driving position, he simply rotates the chuck casing as far as possible in the required direction and can see the cams which protrude in the appropriate direction as a result. To set the off position he rotates the casing until he feels the detent roller enter the detent, at which point he will see one end of each cam raised slightly above the casing surface. He will then rotate the casing in the opposite direction until he feels the detent spring pawl elements engage with the steps in the chamber wall, at which point he will be able to see that the cams lie flush with the casing surface.

The chuck of the embodiment is therefore easily and quickly switchable between the three positions without requiring any disassembly as in conventional systems.

Torque Control

For any particular winding operation it is usually desirable to wind the web at a predetermined web tension to achieve the best winding quality. As the diameter of a reel increases during winding, a shaft such as the drive shaft 9 described above may be used to vary the torque supplied to each chuck. This is achieved by driving the shaft at a desired overspeed relative to the reel speed and controlling the air pressure within the inflatable tubes 36 which urge the friction segments 34 against the inner ring 30 of each chuck. In practice, it will be possible to control the air pressure only between certain limits and therefore to control the force exerted by the friction segments on the inner rings and the torque applied to the inner rings only between certain limits. Importantly, therefore, there is a minimum torque which can be satisfactorily applied to each chuck.

If it is desired to wind a wide web at low web tension, a problem can arise when using a conventional differential shaft because the core required for the wide web spans many chucks. Since each chuck cannot transmit a torque below a certain minimum torque, the minimum torque which can be applied to the wide core is multiplied by the number of chucks within it. This minimum torque may exceed the desired web tension, particularly near the beginning of winding when the reel diameter is small.

Using the embodiment of the invention, before loading the core, the operator may switch off as many as desired of the chucks which the core will cover to reduce the minimum torque which can be applied to the core. Normally, at least two chucks would be left switched on, one near each end of the core.

The maximum torque required during a winding operation must also be considered. To maintain a constant web tension, the torque must be increased during winding in proportion to the increasing diameter of the reel. This is achieved by increasing the air pressure within the inflatable tubes in the shaft but sufficient chucks must be left switched on beneath a core in order to apply the maximum required tension.

It will therefore be seen that in the embodiment of the invention the number of chucks switched on can be tailored to any particular winding operation so that the required range of torque can be applied to the or each core. A further advantage is that the torque can be more accurately controlled during winding because the operator can, by selecting an appropriate number of chucks to transfer the torque, ensure that the range of air pressure required during winding is conveniently within the range of control of air pressure of the winding machine. For example, if a required range of torque can be applied either by a small variation in air pressure applied to a large number of chucks or by a large variation in air pressure applied to fewer chucks, it is likely that the second option will provide more accurate torque control because of the wider range of air pressure used.

A consequence of the minimal transfer of torque via the ball races of each chuck is that substantially all torque is transferred through the friction segments rather than the chuck bearings (as tends to occur when plain bearings are used), and therefore that the torque transferred is directly proportional to the air pressure in the inflatable tubes (assuming that the torque transferred is proportional to the force between the friction segments and the chuck inner rings). Therefore, for example, air pressure can be controlled in proportion to reel diameter to give accurately constant tension winding. Any other desired tension variation can also, of course, be achieved.

In conventional chucks using plain bearings, a significant torque is transferred through the bearings, which further raises the minimum torque which a single chuck can supply to a core and prevents torque being related to, or proportional to, air pressure.

In the embodiment, the ball race assemblies require no lubrication, the balls being of steel and the inner race and chuck casing being of moulded acetal or the like.

The use of ball races also means that friction between the shaft and the chuck casings is unaffected by the weight of the reels during winding and any lay-on roller forces, which tend to increase friction if conventional plain bearings are used.

A further advantage of the embodiment is the provision of four evenly spaced cam elements operated simultaneously from a single inner ring which ensures concentric core pick up. In addition, the chuck is advantageously switchable to allow bidirectional operation.

The radial thickness of each chuck in the embodiment is advantageously less than that of conventional chucks, allowing an increased shaft diameter to be used. In the embodiment, the shaft diameter is 55 mm for a three inch internal diameter core giving higher load capabilities than conventional 50 mm shafts.

FURTHER EMBODIMENTS

A number of variations from the embodiment of FIGS. 4 to 31 are possible. For example, different numbers of cam elements 40 and switching elements 80 can be used. In principle, only one cam element may be required to grip the interior of a core, but unless the core were a very snug fit around the casing, the core would then not be supported co-axially with the chuck and the drive shaft, which may cause undesirable vibrations during winding. It is therefore preferable to use three or more cam elements spaced evenly around the chuck so that the core is symmetrically supported even under load during winding.

The number of switching elements may also be varied. In the embodiment, it is convenient to provide the same number of switching elements as cam elements, the switching elements and cam elements alternating around the chuck. Using a plurality of switching elements provides a smoothly-operating chuck in which the action of the switching elements in combination is sufficiently positive for an operator to be easily able to feel, for example, the detent rollers "clicking" into the detents while each individual switching element is relatively lightly constructed in an alternative, to reduce cost, a single switching element 80 might be used, the chuck employing only a single detent spring and detent roller. The detent spring would then need to be more rigid that the detent springs in the embodiment described above to achieve a similarly positive switching action. This may lead to increased wear and reduced smoothness of operation because the toque urging relative rotation of the inner ring and the casing due to the action of the detent spring on the detent roller would then only be applied at one point around the circumference of the chuck. Clearly, however, a reduction in cost may be obtained by reducing the number of switching elements and/or cam elements.

Figure 34:
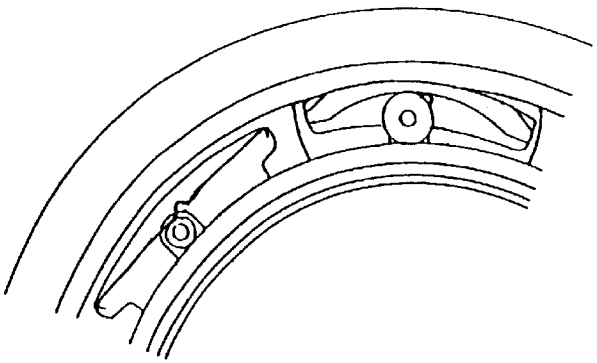
FIG. 34 is an axial section of the switching element and the cam element of FIG. 33 in a core-loading position.
Figure 33:
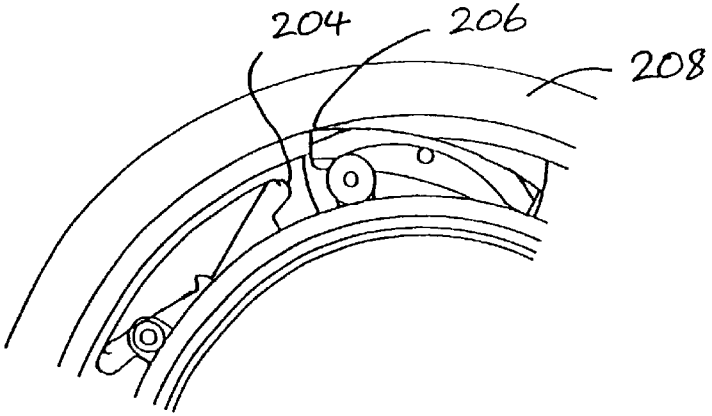
FIG. 33 is an axial section of a switching element and a cam element of a chuck according to a further embodiment of the invention in an anticlockwise driving position.
Figure 35:
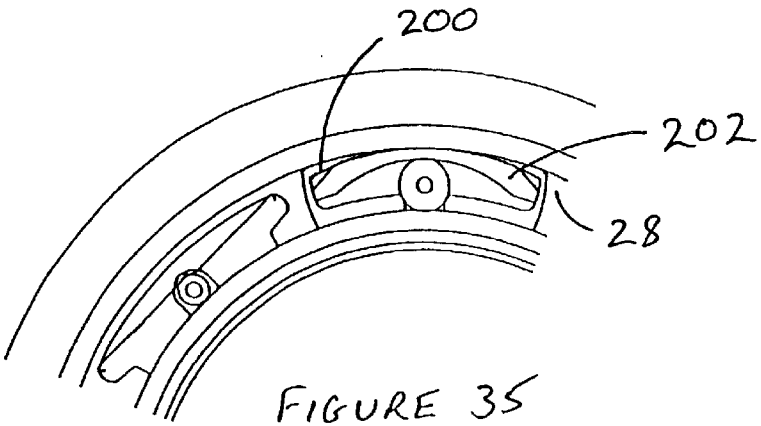
FIG. 35 is an axial section of the switching element and the cam element of FIG. 33 in an off position.

In FIGS. 33, 34 and 35 a further variation of the embodiment described above is shown. In this embodiment, the switching element chamber is shortened so that it ends at approximately the position of the steps 100 in the radially-outer surface of the chamber of the first embodiment. Also, the outer surface 200 of the cam 202 is more sharply curved than the outer surface of the casing 28. The operation of the embodiment is as follows. In the clockwise or anticlockwise driving position, this embodiment operates in the same way as the first embodiment. In particular, the pawl at one end of the detent spring abuts an end surface 204 of the switching element chamber. The detent spring urges the detent element to the opposite end of the chamber and thus urges an end 206 of the cam 202 into engagement with the inner surface of a surrounding core 208. FIG. 33 shows a switching element and an adjacent cam element in the anticlockwise driving position of the chuck.

When a core is slid over a chuck which has been switched to one of its driving positions, it is necessary for the core to be able to depress the raised end 206 of the cam until it is flush with the outer surface of the casing without causing sufficient relative rotation of the casing and the inner ring to engage the detent roller in the detent. In the first embodiment, this was achieved by allowing the detent spring to move circumferentially off-centre within the switching element chamber. In this further embodiment the same goal is achieved by means of the increased curvature of the outer surface 200 of the cam. This allows the end 206 of the cam to be depressed flush with the outer surface of the casing without moving the cam roller to the centre of the cam. This position is illustrated in FIG. 34. In this position, because the cam roller has not moved to a central position, neither has the detent roller, and therefore the detent roller does not engage the detent.

In order to switch a chuck to the "off" position, an operator only needs to apply air pressure to the. inflatable tubes within the drive shaft 9 to lock the inner ring of the chuck and to rotate the casing until the detent roller engages the detent. At this point, both the detent roller and the cam roller are centered and the cam is aligned circumferentially. This position is shown in FIG. 35, and it should be noted that because of the increased curvature of the outer surface 200 of the cam 202, i n this position both ends 206 of the cam are beneath the casing outer surface.

In order to reach the other driving position, the operator simply moves the casing until the detent roller passes beyond the detent.

As in the first embodiment, this further embodiment may comprise any suitable number of switching elements and cam elements.

Advantageously, the construction of these embodiments, like any of the embodiments described herein, can easily be modified to manufacture a unidirectional switchable chuck having, for example, only an anticlockwise driving position and an off position, and no clockwise driving position.

Figure 32:
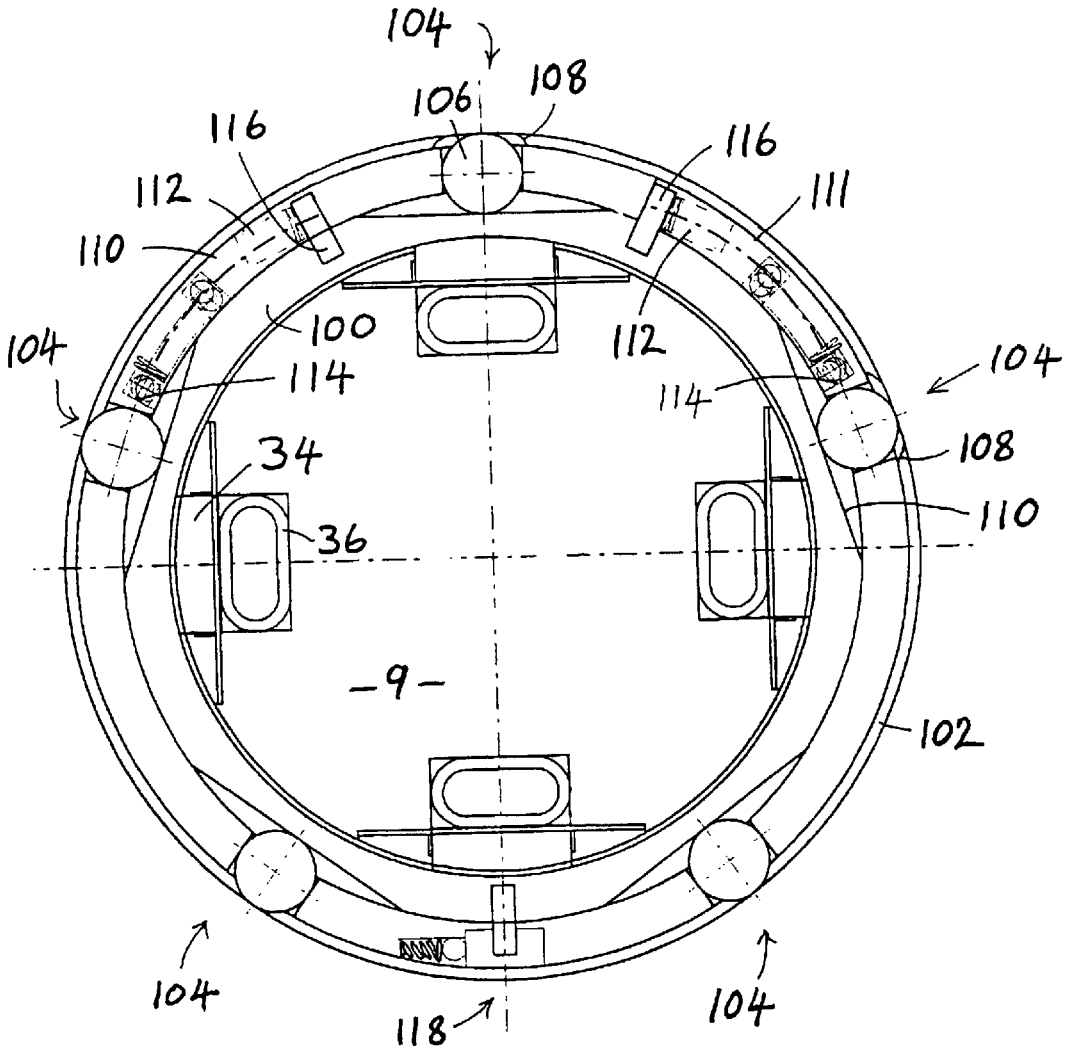
FIG. 32 is an axial section of a chuck according to a second embodiment of the invention mounted on a shaft.

FIG. 32 illustrates a switchable chuck according to a further embodiment of the invention. FIG. 32 is an axial cross section showing a drive shaft 9 similar to that in the first embodiment, incorporation friction segments 34 controlled by inflatable tubes 36. The chuck comprises an inner ring 100 on which the friction segments act. It also comprises an outer casing 102 which is freely rotatable on bearings (preferably ball bearings) relative to the shaft. The chuck of the second embodiment comprises five cam elements 104, evenly spaced around the chuck, for gripping a core. Each cam element comprises a ball 106 captive between an opening 108 in the outer surface of the casing and a flat cam section 110 formed in an outer surface of the inner ring 100. Thus, as the inner ring rotates relative to the casing, the captive ball is urged radially outwards, a portion of the ball extending proud of the outer surface of the casing to grip the core.

In a further embodiment, a cam element of this type could be used in place of the pivoting-cam cam elements of the first embodiment. As in the first embodiment, it can be seen that the cam element of the second embodiment is bi-directional, for transmitting torque anticlockwise or clockwise.

The chuck of the embodiment of FIG. 32 further comprises a switching element as follows. Two chambers 110, 111 within the casing each contain a circumferentially-oriented coil spring 112. Each chamber is bounded at one end by a wall 114 of the chamber and at the other by a pin 116 extending from the inner ring into the chamber. In each chamber, the spring urges the wall 114 and the pin 116 apart. However, the chambers are oriented such that the spring in one chamber 110 urges the casing anticlockwise relative to the inner ring and the spring in the other chamber 111 urges the casing clockwise relative to the inner ring.

The switch element of the second embodiment further comprises a switch 118 mounted in the casing and which can be moved between two positions. In a first position, the switch engages a pin in one of two slots in the inner ring, restricting the range of relative rotation of the inner ring and the casing over one of two ranges. Over one of the resulting ranges of rotation, the spring in one of the chambers 110 is always compressed relative to the spring in the other chamber 111. The outer ring is consequently urged anticlockwise relative to the inner ring, which tends to raise the balls 106 in the cam elements. This situation is suitable for transferring anticlockwise torque from the shaft to a core held by the clutch. When the switch 118 limits the relative rotation of the inner ring and the casing to the second available range, the spring in the other chamber 111 is always held in a compressed state relative to the spring chamber 110. This urges the casing clockwise relative to the inner ring, tending to raise the balls of the cam elements when a clockwise torque is applied by the drive shaft. An operator engages one of these two positions by first locking the position of the inner ring by applying air pressure to the inflatable tubes within the shaft, then with the switch in the off position rotating the casing to pre-load the appropriate spring 112, and finally moving the switch to the driving position to restrain the relative rotation of the inner ring and the casing over the required range of movement.

If the switch is moved to the off position, the range of movement of the inner and outer rings is not limited. The springs in the chamber 110, 111 therefore tend to retain the casing in a position relative to the inner ring such that the balls 106 of the cam elements are centred on the cam surfaces 110 of the inner ring. The balls therefore do not rise to grip the core and no torque can be transferred to the core.

In a further embodiment, moving the switch to the off position locks the inner ring to the casing in a central position such that all the balls are withdrawn.

Further details of the operation of the second embodiment are similar to those of the first embodiment so will not be described further.

It should be noted that the switching elements of these further embodiments may be combined with the cam element of the first embodiment if desired.

In further embodiments, it would be possible in principle to employ plain bearings rather than ball races to reduce cost. However, as described above, this would reduce performance by increasing friction between the casing and the shaft, particularly under load. It should be noted, however, that using the switching element of the embodiment to switch individual chucks off, the problems of torque transmission as a result of friction between the shaft and the chuck casings may be reduced.

What is claimed is:

1. A chuck receivable on a drive shaft of a winding apparatus for supporting and driving a core of a reel, comprising;

an inner ring for encircling the drive shaft and to which torque can be applied from the drive shaft during use;

a casing encircling the inner ring and having an outside diameter less than or equal to the internal diameter of a core;

a core driving element including a core engaging element for engaging an inner surface of a core surrounding the chuck during use to prevent relative rotation of the casing and the core, the core engaging element engaging the inner surface of the core in response to relative rotation of the inner ring and the casing; and a switching element for controlling relative rotation of the inner ring and the casing so that, with the switching element in a first state, a torque applied to the inner ring causes the core engaging element to engage the core, and with the switching element in a second state, relative rotation of the inner ring and the casing is restricted so that the core engaging element does not engage the core.

2. A chuck according to claim 1 comprising three or more core driving elements spaced around the casing to centralize a core supported on the core engaging elements.

3. A chuck according to claim 1 in which the core driving element can drive the core clockwise or anticlockwise, and the first state of the switching element includes an anticlockwise driving state and a clockwise driving state.

4. A chuck according to claim 1 in which the core engaging element comprises a cam pivotably mounted on the casing, an end or either end of the cam being raisable proud of the casing, to engage a core, by a cam operator carried by the inner ring acting on a cam surface of the cam.

5. A chuck according to claim 4 in which the cam operator is a cam roller.

6. A chuck according to claim 4 in which a side of the or each end of the cam is chamfered to enable a core to be slid over the chuck when the end of the cam is raised, depressing a raised end of the cam by forcing a relative rotation of the inner ring and the casing.

7. A chuck according to claim 1 in which the core engaging element comprises a ball held captive between an opening in a radially outer surface of the casing and a cam surface of the inner ring, relative rotation of the inner ring and the casing causing the cam surface to raise the ball partially through the opening to engage a core surrounding the chuck.

8. A chuck according claim 1 in which the switching element comprises a detent spring retained in a chamber within the casing and a corresponding detent element connected to the inner ring, in which in the second state of the switching element the detent element engages a detent of the detent spring and in the first state of the switching element the detent spring acts on the detent element to urge relative rotation of the inner ring and the casing and operation of the core engaging element.

9. A chuck according to claim 1 in which the switching element comprises a detent spring retained in a chamber within the inner ring and a corresponding detent element connected to the casing, in which in the second state of the switching element the detent element engages a detent of the detent spring and in the first state of the switching element the detent spring acts on the detent element to urge relative rotation of the inner ring and the casing and operation of the core engaging element.

10. A chuck according to claim 8 in which in the first state of the switching element the detent element may be positioned on either side of the detent and urged correspondingly to provide either an anticlockwise driving position or a clockwise driving position of the switching element.

11. A chuck according to claim 10 in which pawls at each end of the detent spring are releasably engageable with steps on a corresponding surface of the chamber to retain the detent spring and the detent centrally within the chamber in the second state of the switching element, while in the first state of the switching element one of the pawls is moved over its step to abut an end wall of the chamber and the detent moves towards that end of the chamber accordingly, so that the detent element can be positioned at the center of the chamber to withdraw the core engaging elements without engaging the detent.

12. A chuck according to claim 8 in which the detent element is a roller.

13. A chuck according to claim 1 comprising is a plurality of switching elements.

14. A chuck according to claim 1 in which the switching element comprises a chamber containing a spring for urging relative rotation of the inner ring and the casing and a switch to switchably limit the relative rotation, in the first state of the switching element the switch being in a first position allowing the spring to urge relative rotation and operation of the core engaging element and in the second state of the switching element the switch being in a second position limiting the relative motion to prevent operation of the core engaging element.

15. A chuck according to claim 1 in which the switching element comprises two chambers containing springs respectively urging relative rotation of the inner ring and the casing in opposite directions and a switch to switchably limit the relative rotation, in the first state of the switching element the switch being set to compress one of the springs relative to the other, to urge relative rotation in the direction caused by the more compressed spring and operation of the core engagement element for that direction, and in the second state of the switching element the switch being set to allow the two springs to apply equal and opposite forces to urge the inner ring and the casing to a relative position in which the core engaging element is withdrawn.

16. A chuck according to claim 1 in which the casing is supported on the drive shaft by ball bearings.

17. A chuck according to claim 1 which can be switched into the first state or the second state by an operator without removing the chuck from its drive shaft.

18. A chuck according to claim 17 in which switching the chuck to the first state includes switching it into a clockwise winding condition or an anticlockwise winding condition.

19. A differential shaft for a winding machine carrying a row of chucks as defined in claim 1.

20. A chuck according to claim 9 in which in the first state of the switching element the detent element may be positioned on either side of the detent and urged correspondingly to provide either an anticlockwise driving position or a clockwise driving position of the switching element.

21. A chuck according to claim 9 in which the detent element is a roller.

22. A method for switchably transferring torque from a drive shaft to a winding core by means of a chuck, comprising:

providing a core driving element of the chuck having a core engaging element operational to drive and support the core surrounding the chuck;

providing a switching element of the chuck to control the operation of the core engagement element; and before a winding operation, switching the switching element either;

into a clockwise winding condition in which the core engaging element operates and torque can be transferred from the drive shaft to the core in a clockwise direction, and not in an anti-clockwise direction; or into an anti-clockwise winding condition in which the core engaging element operates and torque can be transferred from the drive shaft to the core in an anti-clockwise direction, and not in a clockwise direction; or into a state in which operation of the core engaging element is prevented and torque cannot be transferred from the drive shaft to the core.

* * * * *